US011612297B2

(12) United States Patent
Weigel et al.

(10) Patent No.: US 11,612,297 B2
(45) Date of Patent: Mar. 28, 2023

(54) AUTONOMOUS FLOOR CLEANER WITH CARRY HANDLE

(71) Applicant: BISSELL Inc., Grand Rapids, MI (US)

(72) Inventors: Nicholas Weigel, Rockford, MI (US); Steve M. Johnson, Hudsonville, MI (US); Todd R. VanTongeren, Ada, MI (US); Matthew Haverkamp, Kentwood, MI (US)

(73) Assignee: BISSELL Inc., Grand Rapids, MI (US)

( * ) Notice: Subject to any disclaimer, the term of this patent is extended or adjusted under 35 U.S.C. 154(b) by 88 days.

(21) Appl. No.: 17/408,595

(22) Filed: Aug. 23, 2021

(65) Prior Publication Data

US 2021/0378479 A1 Dec. 9, 2021

Related U.S. Application Data

(63) Continuation of application No. 16/896,536, filed on Jun. 9, 2020, now Pat. No. 11,129,512.

(Continued)

(51) Int. Cl.

*A47L 11/40* (2006.01)
*A47L 9/32* (2006.01)

(Continued)

(52) U.S. Cl.

CPC ..... *A47L 11/4075* (2013.01); *A47L 9/2805* (2013.01); *A47L 9/2842* (2013.01); *A47L 9/2847* (2013.01); *A47L 9/32* (2013.01); *A47L 11/24* (2013.01); *A47L 11/292* (2013.01); *A47L 11/4002* (2013.01); *A47L 11/4011* (2013.01); *A47L 11/4016* (2013.01); *A47L 11/4025* (2013.01); *A47L 11/4041* (2013.01); *A47L 11/4061* (2013.01); *A47L 11/4066* (2013.01);

(Continued)

(58) Field of Classification Search

CPC .. A47L 11/4075; A47L 9/2805; A47L 9/2842; A47L 9/2847; A47L 9/32; A47L 11/24; A47L 11/292; A47L 11/4002; A47L 11/4011; A47L 11/4016; A47L 11/4025; A47L 11/4041; A47L 11/4061; A47L 11/4066; A47L 2201/04; A47L 2201/06; A47L 11/4083; A47L 2201/00; A47L 11/4013; A47L 11/4044; A47L 11/4094

See application file for complete search history.

(56) References Cited

U.S. PATENT DOCUMENTS 5,901,408 A 5/1999 Miller et al.
8,438,695 B2 5/2013 Gilbert, Jr. et al.

(Continued)

FOREIGN PATENT DOCUMENTS

CN 204169788 U 2/2015
KR 20080028219 A 3/2008

(Continued)

*Primary Examiner* — David Redding

(74) *Attorney, Agent, or Firm* — Warner Norcross + Judd LLP

(57) ABSTRACT

An autonomous floor cleaner can include a housing, a drive system for autonomously moving the housing over the surface to be cleaned, a controller for controlling the operation of the autonomous floor cleaner, a tank adapted to hold liquid, and a carry handle joined with the tank and/or the housing. The carry handle is movable between different positions, including a position in which the autonomous floor cleaner can be lifted via the carry handle while an inlet and/or outlet of the tank is blocked.

20 Claims, 11 Drawing Sheets

Related U.S. Application Data

(60) Provisional application No. 62/859,266, filed on Jun. 10, 2019.

(51) Int. Cl.
*A47L 9/28* (2006.01)
*A47L 11/24* (2006.01)
*A47L 11/292* (2006.01)

(52) U.S. Cl.
CPC ..... *A47L 2201/04* (2013.01); *A47L 2201/06* (2013.01)

(56) References Cited

U.S. PATENT DOCUMENTS

| | | | |
|---|---|---|---|
| 9,757,004 | B2 | 9/2017 | Neumann et al. |
| 2014/0312813 | A1 | 10/2014 | Murchie et al. |
| 2016/0270618 | A1 | 9/2016 | Lu et al. |
| 2017/0280960 | A1 | 10/2017 | Ziegler et al. |
| 2019/0200826 | A1 | 7/2019 | Burbank et al. |

FOREIGN PATENT DOCUMENTS

| | | | |
|---|---|---|---|
| WO | 2011100678 | A2 | 8/2011 |
| WO | 2013105431 | A1 | 7/2013 |

AUTONOMOUS FLOOR CLEANER WITH CARRY HANDLE

CROSS-REFERENCE TO RELATED APPLICATION(S)

This application is a continuation of U.S. patent application Ser. No. 16/896,536, filed Jun. 9, 2020, which claims the benefit of U.S. Provisional Application No. 62/859,266, filed Jun. 10, 2019, both of which are incorporated herein by reference in their entirety.

BACKGROUND

Autonomous or robotic floor cleaners can move without the assistance of a user or operator to clean a floor surface. For example, the floor cleaner can be configured to vacuum or sweep dirt (including dust, hair, and other debris) into a collection bin carried on the floor cleaner. The floor cleaner can move randomly about a surface while cleaning the floor surface or use a mapping/navigation system for guided navigation about the surface.

Some autonomous or robotic floor cleaners are further configured to apply and extract liquid for wet cleaning of bare floors, carpets, rugs, and other floor surfaces. Such floor cleaners include a supply tank for storing a supply of cleaning liquid and a recovery tank for collecting dirty liquid. These tanks can be removable from the floor cleaner for easy refilling and emptying, respectively.

Users often pick up autonomous or robotic floor cleaners from the floor surface and carry them to different location, such as to deliver the floor cleaner to a new area to be cleaned, to return the floor cleaner to a docking station for recharging, or to take the floor cleaner to a convenient location for maintenance and servicing of the floor cleaner. When lifting and carrying a wet cleaning robot, liquid in the supply and recovery tanks can slosh around and spill out. This can also be an issue when emptying the recovery tank when it is separated from the floor cleaner.

BRIEF SUMMARY

In one aspect, the disclosure relates to an autonomous floor cleaner having a carry handle. In one embodiment, the autonomous floor cleaner includes an autonomously moveable housing, a drive system for autonomously moving the housing over the surface to be cleaned, a controller for controlling the operation of the autonomous floor cleaner, a tank adapted to hold liquid, and a carry handle joined with the tank and/or the housing. The carry handle is movable between a first position and a second position. In the second position, the autonomous floor cleaner can be lifted via the carry handle In certain embodiments, the tank includes an inlet and an outlet. The carry handle can include a mechanism to block the inlet and/or outlet of the tank when the carry handle is in the carry position.

The blocking mechanism can include a cap with a gasket that seals against the inlet and/or outlet of the tank when the carry handle is in the carry position. In certain embodiments, the weight of the tank is distributed such that it tends to apply force through the blocking mechanism to compress the gasket.

These and other features and advantages of the present disclosure will become apparent from the following description of particular embodiments, when viewed in accordance with the accompanying drawings and appended claims.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. In addition, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components. Any reference to claim elements as "at least one of X, Y and Z" is meant to include any one of X, Y or Z individually, and any combination of X, Y and Z, for example, X, Y, Z; X, Y; X, Z; and Y, Z.

DETAILED DESCRIPTION

The disclosure generally relates to autonomous floor cleaners for cleaning floor surfaces, including bare floors such as hardwood, tile and stone, and soft surfaces such as carpets and rugs. More specifically, the disclosure relates to handles for carrying autonomous floor cleaners and/or tanks of autonomous floor cleaners.

Figure 1:
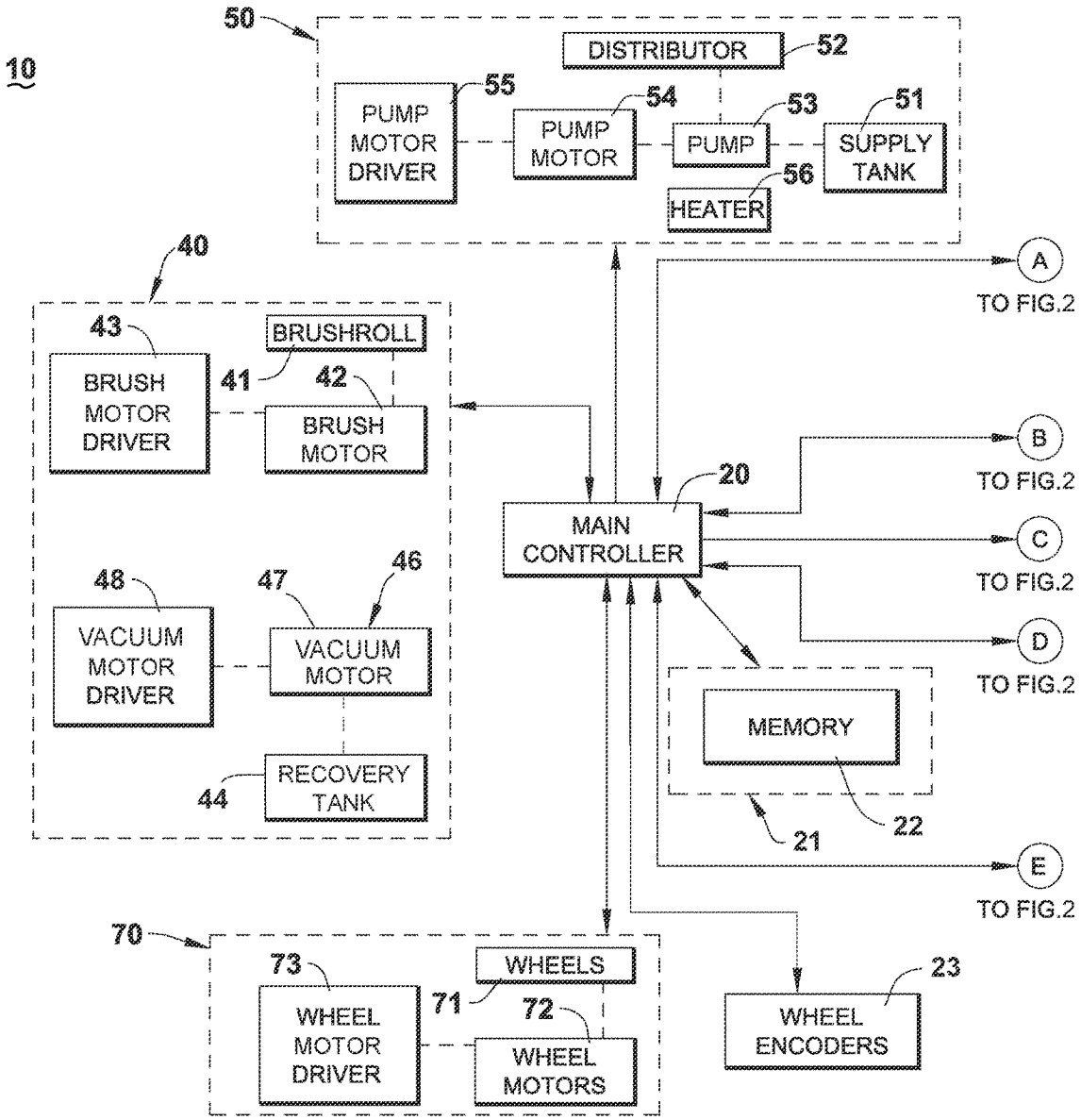
FIG. 1 is a schematic view of an exemplary autonomous floor cleaner illustrating functional systems in accordance with various aspects described herein.
Figure 2:
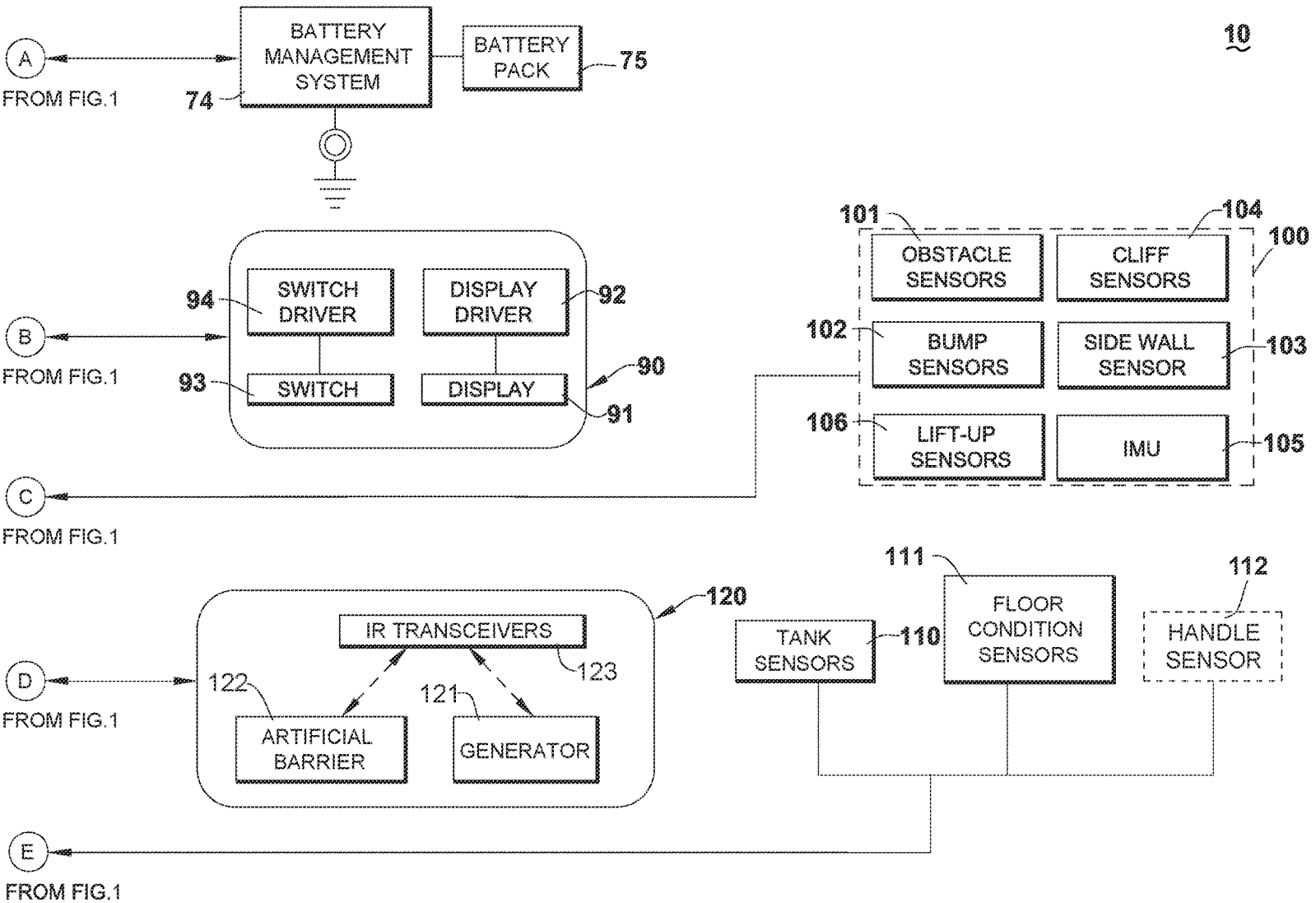
FIG. 2 is a schematic view of the autonomous floor cleaner of FIG. 1 illustrating additional functional systems in accordance with various aspects described herein.

FIGS. 1 and 2 illustrate a schematic view of an autonomous floor cleaner, such as a floor cleaning robot 10, also referred to herein as a robot 10. It is noted that the robot 10 shown is but one example of a floor cleaning robot configured to mop or otherwise conduct a wet cleaning cycle of operation, and that other autonomous cleaners requiring liquid supply and/or recovery are contemplated, including, but not limited to autonomous floor cleaners capable of delivering liquid, steam, mist, or vapor to the surface to be cleaned.

The robot 10 can include components of various functional systems in an autonomously moveable unit. The robot 10 can include a chassis or main housing 12 (FIG. 3) adapted to selectively mount components of the systems to form a unitary movable device. A controller 20 is operably coupled with the various functional systems of the robot 10 for controlling the operation of the robot 10. The controller 20 can be a microcontroller unit (MCU) that contains at least one central processing unit (CPU).

A navigation/mapping system 21 can be provided in the robot 10 for guiding the movement of the robot 10 over the surface to be cleaned, generating and storing maps of the surface to be cleaned, and recording status or other environmental variable information. The controller 20 can receive input from the navigation/mapping system 21 or from a remote device such as a smartphone (not shown) for directing the robot 10 over the surface to be cleaned. The navigation/mapping system 21 can include a memory 22 that can store any data useful for navigation, mapping or conducting a cycle of operation, including, but not limited to, maps for navigation, inputs from various sensors that are used to guide the movement of the robot 10, etc. For example, wheel encoders 23 can be placed on the drive shafts of wheels coupled to the robot 10 and configured to measure a distance traveled by the robot 10. The distance measurement can be provided as input to the controller 20.

In an autonomous mode of operation, the robot 10 can be configured to travel in any pattern useful for cleaning or sanitizing including boustrophedon or alternating rows (that is, the robot 10 travels from right-to-left and left-to-right on alternate rows), spiral trajectories, etc., while cleaning the floor surface, using input from various sensors to change direction or adjust its course as needed to avoid obstacles. In a manual mode of operation, movement of the robot 10 can be controlled using a mobile device such as a smartphone or tablet.

The robot 10 can also include at least the components of a recovery system 40 for removing liquid and debris from the surface to be cleaned, a delivery system 50 for storing cleaning fluid and delivering the cleaning fluid to the surface to be cleaned, and a drive system 70 for autonomously moving the robot 10 over the surface to be cleaned.

In the embodiment illustrated herein, the recovery system 40 is configured to generate a partial vacuum at the surface to be cleaned for removing liquid and debris from the surface to be cleaned, as described in more detail below. Alternatively, the recovery system 40 can be configured as a sweeping or mechanical collection system that mechanically collects liquid and debris without the use of suction. In yet another alternative or additional collection mechanism, a mopping or dusting assembly can be provided for removing moistened dirt and other debris from the surface to be cleaned, and can include at least one stationary or rotatable cleaning pad.

The recovery system 40 can include a recovery pathway through the housing 12 having an air inlet defined by a suction nozzle 45 (FIG. 3) and an air outlet (not shown), a debris receptacle, bin, or recovery tank 44 for receiving recovered liquid and/or debris and collecting the liquid and/or debris on board the robot for later disposal, and a suction source 46 in fluid communication with the suction nozzle 45 and the recovery tank 44 for generating a working air stream through the recovery pathway. The suction source 46 can include a vacuum motor 47 located fluidly upstream of the air outlet, and can define a portion of the recovery pathway.

The recovery system 40 can also include at least one agitator for agitating the surface to be cleaned. The agitator can be in the form of a brushroll 41 mounted for rotation about a substantially horizontal axis, relative to the surface over which the robot 10 moves. A drive assembly including a separate, dedicated brush motor 42 can be provided within the robot 10 to drive the brushroll 41. Other agitators or brushrolls can also be provided, including one or more stationary or non-moving brushes, or one or more brushes that rotate about a substantially vertical axis.

The suction nozzle 45 shown herein is positioned in close proximity to the brushroll 41 to collect liquid and debris directly from the brushroll 41. In other embodiments, the suction nozzle 45 can be positioned to confront the surface to be cleaned to remove liquid and debris from the surface, rather than the brushroll 41.

The recovery tank 44 can define a portion of the recovery pathway and can comprise a separator (not shown) for separating liquid and debris from the working airstream. Optionally, a pre-motor filter and/or a post-motor filter (not shown) can be provided in the recovery pathway as well. The recovery pathway can further include various conduits, ducts, or tubes for fluid communication between the various components of the recovery system 40. The vacuum motor 47 can be positioned downstream of the recovery tank 44 in the recovery pathway. In other embodiments, the vacuum motor 47 may be located fluidly upstream of the recovery tank 44.

The delivery system 50 can include a supply tank 51 for storing a supply of cleaning fluid on board the robot 10, and at least one fluid distributor 52 in fluid communication with the supply tank 51 for depositing a cleaning fluid onto the surface. The cleaning fluid can be a liquid such as water or a cleaning solution specifically formulated for hard or soft surface cleaning. The fluid distributor 52 can be one or more spray nozzles provided on the housing 12 with an orifice of sufficient size such that debris does not readily clog the nozzle. Alternatively, the fluid distributor 52 can be a manifold having multiple distributor outlets.

A pump 53 can be provided in the fluid pathway between the supply tank 51 and the at least one fluid distributor 52 to control the flow of fluid to the at least one fluid distributor 52. The pump 53 can be driven by a pump motor 54 to move liquid at any flowrate useful for a cleaning cycle of operation.

Various combinations of optional components can also be incorporated into the delivery system 50, such as a heater 56 or one or more fluid control and mixing valves. The heater 56 can be configured, for example, to warm up the cleaning fluid before it is applied to the surface. In one embodiment, the heater 56 can be an in-line fluid heater between the supply tank 51 and the distributor 52. In another example, the heater 56 can be a steam generating assembly. The steam assembly is in fluid communication with the supply tank 51 such that some or all the liquid applied to the floor surface is heated to vapor.

The drive system 70 can include drive wheels 71 for driving the robot 10 across a surface to be cleaned. The drive wheels 71 can be operated by a common wheel motor 72 or individual wheel motors coupled with the drive wheels 71 by a transmission, which may include a gear train assembly or another suitable transmission. The drive system 70 can receive inputs from the controller 20 for driving the robot 10 across a floor, based on inputs from the navigation/mapping system 21 for the autonomous mode of operation or based on inputs from a smartphone, tablet, or other remote device for the manual mode of operation. The drive wheels 71 can be driven in a forward or reverse direction to move the unit forwardly or rearwardly. Furthermore, the drive wheels 71 can be operated simultaneously at the same rotational speed for linear motion or independently at different rotational speeds to turn the robot 10 in a desired direction.

The robot 10 can include any number of motors useful for performing locomotion and cleaning. In one example, four dedicated motors can be provided to rotate the brushroll 41, each of two drive wheels 71, and generate a partial vacuum at the suction nozzle 45. In another example, one shared motor can rotate the brushroll 41 and generate a partial vacuum at the suction nozzle 45, and a second and third motor can rotate each drive wheel 71. In still another example, one shared motor can rotate the brushroll 41 and generate a partial vacuum at the suction nozzle 45, and a second shared motor can rotate both drive wheels 71.

In addition, a brush motor driver 43, a vacuum motor driver 48, pump motor driver 55, and wheel motor driver 73 can be provided for controlling the brush motor 42, pump motor 54, and wheel motors 72, respectively. The motor drivers 43, 48, 55, 73 can act as an interface between the controller 20 and their respective motors 42, 47, 54, 72. The motor drivers 43, 48, 55, 73 can also be an integrated circuit chip (IC). It is also contemplated that a single wheel motor driver 73 can control multiple wheel motors 72 simultaneously.

Turning to FIG. 2, the motor drivers 43, 48, 55, 73 (FIG. 1) can be electrically coupled to a battery management system 74 that includes a built-in rechargeable battery or removable battery pack 75. In one example, the battery pack 75 can include lithium ion batteries. Charging contacts for the battery pack 75 can be provided on an exterior surface of the robot 10. A docking station (not shown) can be provided with corresponding charging contacts that can mate to the charging contacts on the exterior surface of the robot 10. The battery pack 75 can be selectively removable from the robot 10 such that it can be plugged into mains voltage via a DC transformer for replenishment of electrical power, i.e. charging. When inserted into the robot 10, the removable battery pack 75 can be at least partially located outside the housing 12 (FIG. 3) or completely enclosed in a compartment within the housing 12, in non-limiting examples and depending upon the implementation.

The controller 20 is further operably coupled with a user interface (UI) 90 on the robot 10 for receiving inputs from a user. The user interface 90 can be used to select an operation cycle for the robot 10 or otherwise control the operation of the robot 10. The user interface 90 can have a display 91, such as an LED display, for providing visual notifications to the user. A display driver 92 can be provided for controlling the display 91, and acts as an interface between the controller 20 and the display 91. The display driver 92 may be an IC. The robot 10 can further be provided with a speaker (not shown) for providing audible notifications to the user. The robot 10 can further be provided with one or more cameras or stereo cameras (not shown) for acquiring visible notifications from the user. In this way, the user can communicate instructions to the robot 10 by gestures. For example, the user can wave their hand in front of the camera to instruct the robot 10 to stop or move away. The user interface 90 can further have one or more switches 93 that are actuated by the user to provide input to the controller 20 to control the operation of various components of the robot 10. A switch driver 94 can be provided for controlling the switch 93, and acts as an interface between the controller 20 and the switch 93.

The controller 20 can further be operably coupled with various sensors for receiving input about the environment and can use the sensor input to control the operation of the robot 10. The sensors can detect features of the surrounding environment of the robot 10 including, but not limited to, walls, floors, chair legs, table legs, footstools, pets, and other obstacles. The sensor input can further be stored in the memory or used to develop maps for navigation. Some exemplary sensors are illustrated in FIG. 2, and described below. Although it is understood that not all sensors shown may be provided, additional sensors may be provided, and that all of the possible sensors can be provided in any combination.

The robot 10 can include a positioning or localization system 100. The localization system 100 can include one or more sensors, including but not limited to the sensors described above. In one non-limiting example, the localization system 100 can include obstacle sensors 101 determining the position of the robot 10, such as a stereo camera in a non-limiting example, for distance and position sensing. The obstacle sensors 101 can be mounted to the housing 12 (FIG. 3) of the robot 10, such as in the front of the housing 12 to determine the distance to obstacles in front of the robot 10. Input from the obstacle sensors 101 can be used to slow down or adjust the course of the robot 10 when objects are detected.

Bump sensors 102 can also be provided in the localization system 100 for determining front or side impacts to the robot 10. The bump sensors 102 may be integrated with the housing 12, such as with a bumper. Output signals from the bump sensors 102 provide inputs to the controller 20 for selecting an obstacle avoidance algorithm.

The localization system 100 can include a side wall sensor 103 (also known as a wall following sensor) and a cliff sensor 104. The side wall sensor 103 or cliff sensor 104 can be optical, mechanical, or ultrasonic sensors, including reflective or time-of-flight sensors. The side wall sensor 103 can be located near the side of the housing 12 and can include a side-facing optical position sensor that provides distance feedback and controls the robot 10 so that the robot 10 can follow near a wall without contacting the wall. The cliff sensors 104 can be bottom-facing optical position sensors that provide distance feedback and control the robot 10 so that the robot 10 can avoid excessive drops down stairwells, ledges, etc.

The localization system 100 can also include an inertial measurement unit (IMU) 105 to measure and report the robot's acceleration, angular rate, or magnetic field surrounding the robot 10, using a combination of at least one accelerometer, gyroscope, and, optionally, magnetometer or compass. The inertial measurement unit 105 can be an integrated inertial sensor located on the controller 20 and can be a nine-axis gyroscope or accelerometer to sense linear, rotational or magnetic field acceleration. The IMU 105 can use acceleration input data to calculate and communicate change in velocity and pose to the controller 20 for navigating the robot 10 around the surface to be cleaned.

The localization system 100 can include one or more lift-up sensors 106 which detect when the robot 10 is lifted off the surface to be cleaned e.g. if a user picks up the robot 10. This information is provided as an input to the controller 20, which can halt operation of the pump motor 54, brush motor 42, vacuum motor 47, or wheel motors 72 in response to a detected lift-up event. The lift-up sensors 106 may also detect when the robot 10 is in contact with the surface to be cleaned, such as when the user places the robot 10 back on the ground. Upon such input, the controller 20 may resume operation of the pump motor 54, brush motor 42, vacuum motor 47, or wheel motors 72.

The robot 10 can optionally include one or more tank sensors 110 for detecting a characteristic or status of the recovery tank 44 or supply tank 51. In one example, one or more pressure sensors for detecting the weight of the recovery tank 44 or supply tank 51 can be provided. In another example, one or more magnetic sensors for detecting the presence of the recovery tank 44 or supply tank 51 can be provided. This information is provided as an input to the controller 20, which may prevent operation of the robot 10 until the supply tank 51 is filled, the recovery tank 44 is emptied, or both are properly installed, in non-limiting examples. The controller 20 may also direct the display 91 to provide a notification to the user that either or both of the tanks 44, 51 is missing.

The robot 10 can include one or more floor condition sensors 111 for detecting a condition of the surface to be cleaned. For example, the robot 10 can be provided with an infrared (IR) dirt sensor, a stain sensor, an odor sensor, or a wet mess sensor. The floor condition sensors 111 provide input to the controller that may direct operation of the robot 10 based on the condition of the surface to be cleaned, such as by selecting or modifying a cleaning cycle. Optionally, the floor condition sensors 111 can also provide input for display on a smartphone.

An artificial barrier system 120 can also be provided for containing the robot 10 within a user-determined boundary. The artificial barrier system 120 can include an artificial barrier generator 121 that comprises a barrier housing with at least one signal receiver for receiving a signal from the robot 10 and at least one IR transmitter for emitting an encoded IR beam towards a predetermined direction for a predetermined period of time. The artificial barrier generator 121 can be battery-powered by rechargeable or non-rechargeable batteries or directly plugged into mains power. In one non-limiting example, the receiver can comprise a microphone configured to sense a predetermined threshold sound level, which corresponds with the sound level emitted by the robot 10 when it is within a predetermined distance away from the artificial barrier generator. Optionally, the artificial barrier generator 121 can further comprise a plurality of IR emitters near the base of the barrier housing configured to emit a plurality of short field IR beams around the base of the barrier housing. The artificial barrier generator 121 can be configured to selectively emit one or more IR beams for a predetermined period of time, but only after the microphone senses the threshold sound level, which indicates the robot 10 is nearby. Thus, the artificial barrier generator 121 can conserve power by emitting IR beams only when the robot 10 is near the artificial barrier generator 121.

The robot 10 can have a plurality of IR transceivers (also referred to as "IR XCVRs") 123 around the perimeter of the robot 10 to sense the IR signals emitted from the artificial barrier generator 121 and output corresponding signals to the controller 20, which can adjust drive wheel control parameters to adjust the position of the robot 10 to avoid boundaries established by the artificial barrier encoded IR beam and the short field IR beams. Based on the received IR signals, the controller 20 prevents the robot 10 from crossing an artificial barrier 122 or colliding with the barrier housing. The IR transceivers 123 can also be used to guide the robot 10 toward the docking station, if provided.

In operation, sound (or light) emitted from the robot 10 greater than a predetermined threshold signal level is sensed by the microphone (or photodetector) and triggers the artificial barrier generator 121 to emit one or more encoded IR beams for a predetermined period of time. The IR transceivers 123 on the robot 10 sense the IR beams and output signals to the controller 20, which then manipulates the drive system 70 to adjust the position of the robot 10 to avoid the barriers 122 established by the artificial barrier system 120 while continuing to perform a cleaning operation on the surface to be cleaned.

Optionally, the robot 10 can operate in one of a set of modes. The set of modes can include a wet mode, a dry mode and/or a sanitization mode. During a wet mode of operation, liquid from the supply tank 51 is applied to the floor surface and the brushroll 41 is rotated. During a dry mode of operation, the brushroll 41 is rotated and no liquid is applied to the floor surface. During a sanitizing mode of operation, liquid from the supply tank 51 is applied to the floor surface, the brushroll 41 is rotated, and the robot 10 can select a travel pattern such that the applied liquid remains on the surface of the floor for a predetermined length of time. The predetermined length of time can be any duration that will result in sanitizing floor surfaces including, but not limited to, two to five minutes. However, sanitizing can be effected with durations of less than two minutes and as low as fifteen seconds. During each of the wet mode, dry mode, and sanitization modes of operation, a partial vacuum can be generated at the suction nozzle 45 by the suction source 46 to collect liquid and/or debris in the recovery tank 44. It is also possible for the robot 10 to have one mode of operation, such as the wet mode.

Figure 3:
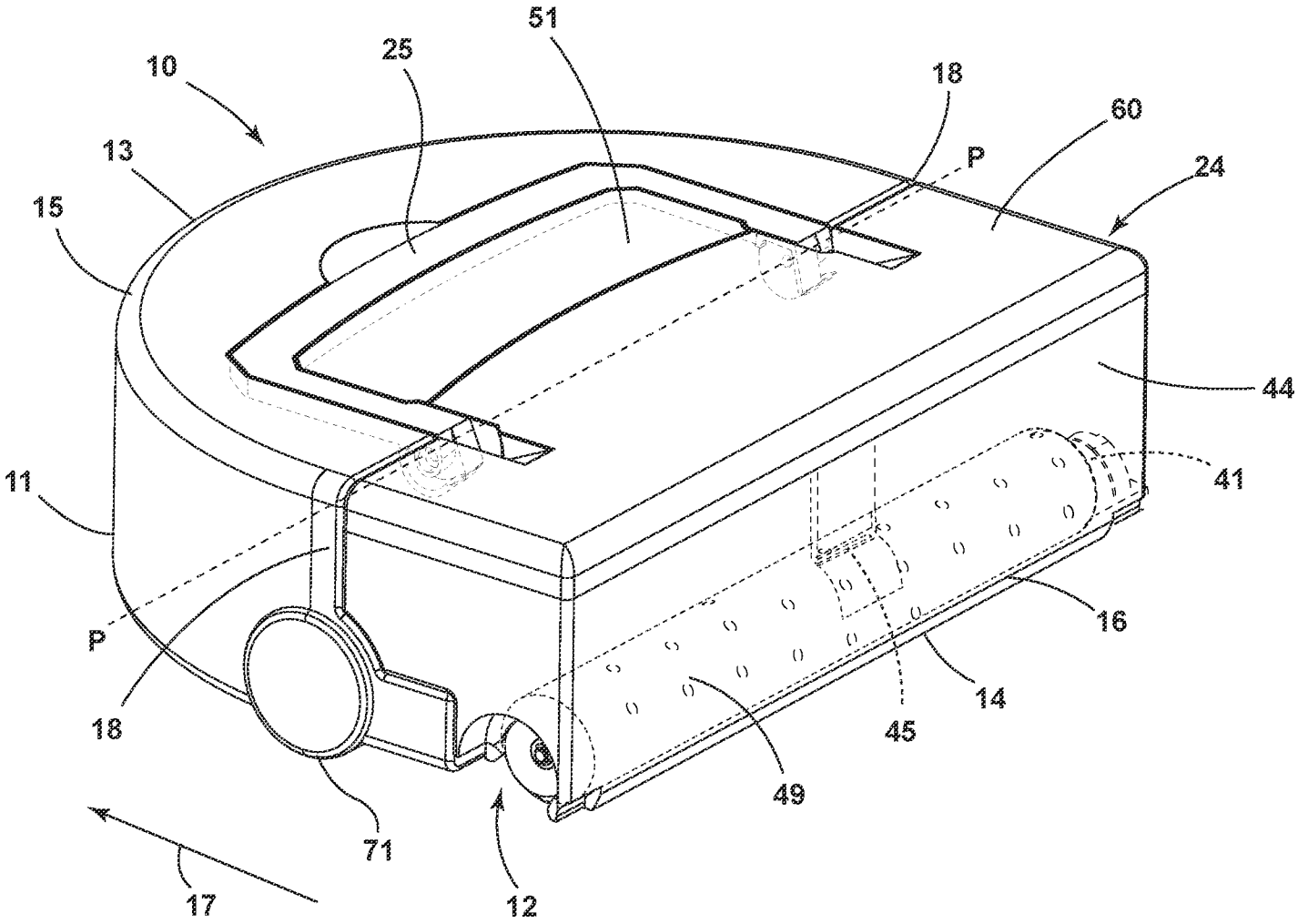
FIG. 3 is a rear isometric view of the autonomous floor cleaner of FIG. 1 in the form of a floor cleaning robot having a tank and a carry handle in accordance with various aspects described herein.

FIG. 3 is a rear isometric view of an exemplary robot 10 that can include the systems and functions described in FIGS. 1-2. As shown, the robot 10 can include a D-shaped housing 12 with a first end 13 and a second end 14. The first end 13 defines a housing front 15 of the robot 10 that is a rounded portion of the D-shaped housing 12, and can be formed by a bumper 11 having the bump sensors 102 (FIG. 2) integrated therewith. The second end 14 can define a housing rear 16 that is a straightedge portion of the D-shaped housing 12. Forward motion of the robot 10 is illustrated with an arrow 17. Lateral sides 18 of the robot 10 extend between the first end 13, or housing front 15, and the second end 14, or housing rear 16. Other shapes and configurations for the robot 10 are possible, including that the rounded portion of the D-shaped housing 12 can define the housing front and the straightedge portion of the D-shaped housing 12 can define the housing rear. Other shapes for the housing 12 are possible, such as substantially circular or substantially rectangular, among others.

The brushroll 41 can be positioned within a brush chamber 49, which can define the suction nozzle 45. The brushroll 41 and brush chamber 49 can be located proximate the second end 14 or housing rear 16, e.g. proximate the straightedge portion of the housing 12. With respect to the direction of forward motion indicated by arrow 17, the brushroll 41 is mounted behind the drive wheels 71. In addition, the recovery tank 44 can be positioned adjacent the brushroll 41 and brush chamber 49. In the illustrated example, the recovery tank 44 is positioned above the brush chamber 49 and brushroll 41, and partially above the drive wheels 71. The supply tank 51 can be positioned rearwardly of the recovery tank 44, and also rearwardly of the brush chamber 49, brushroll 41, and drive wheels 71. Other orientations of the recovery tank 44 and supply tank 51 are possible.

The recovery tank 44 and supply tank 51 can be at least partially formed from a translucent or transparent material, such that an interior space of the tanks 44, 51 is visible to the user. The brush chamber 49 can be at least partially formed from a translucent or transparent material, such that the user can view the brushroll 41.

The recovery tank 44 and supply tank 51 can be separate components on the housing 12. Alternately, the recovery tank 44 and supply tank 51 can be integrated into a single unitary or integrated tank assembly 24 as shown. It is contemplated that the tank assembly 24 can be selectively removed by a user such that both the recovery tank 44 and supply tank 51 are removed together in one action. The tank assembly 24 can be attached to the housing 12 using any suitable mechanism, including any suitable latch, catch, or other mechanical fastener that can join the tank assembly 24 and housing 12, while allowing for the regular separation of the tank assembly 24 from the housing 12.

It is further contemplated that the tank assembly 24 can at least partially, or fully, define the brush chamber 49 and suction nozzle 45, such that the brush chamber 49 and suction nozzle 45 are also removed upon removal of the tank assembly 24, together with the recovery tank 44 and supply tank 51. This can improve usability and serviceability, wherein a user can remove the tank assembly 24 in a single action to empty and rinse out the recovery tank 44, clean the brush chamber 49 and suction nozzle 45, and fill the supply tank 51.

The robot includes a carry handle 25 joined with, or otherwise provided on, the tank assembly 24. The carry handle 25 can be grasped by a user to lift the entire robot 10 from a floor surface and carry the robot 10 to a different location. The carry handle 25 can also be grasped by a user to lift the tank assembly 24 away from the housing 12 and carry the tank assembly 24 to a location for refilling and/or emptying.

In other embodiments, the carry handle 25 can be joined with, or otherwise provided on, the recovery tank 44, the supply tank 51, or the housing 12, separately from either tank 44, 51. In still other embodiments, multiple carry handles can be provided, such as one on the recovery tank 44 and one on the supply tank 51 in an embodiment wherein the tanks 44, 51 are individually removable from the housing 12.

Figure 4:
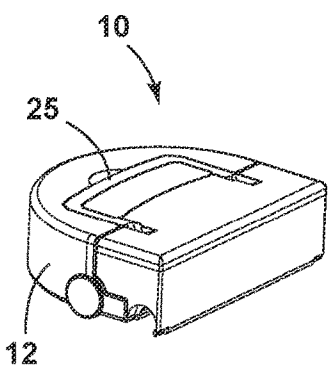
FIG. 4 is a rear isometric view of the robot of FIG. 3 showing the carry handle in a stowed position.
Figure 5:
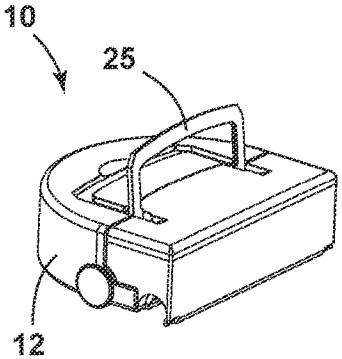
FIG. 5 is a rear isometric view of the robot of FIG. 3 showing the carry handle in a carry position.
Figure 6:
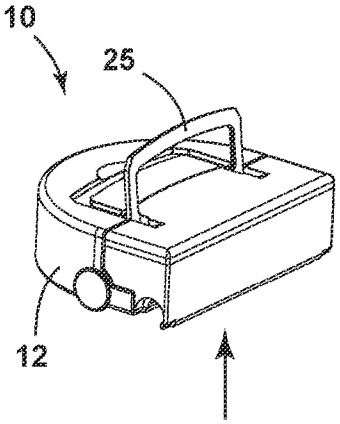
FIG. 6 is a rear isometric view of the robot of FIG. 3 showing the entire robot lifted by the carry handle.

The carry handle 25 is movable between a stowed position, one example of which is shown in FIG. 4, and a carry position, one example of which is shown in FIG. 5. Stowing the carry handle 25 reduces the overall height of the robot 10, providing the robot 10 with a low profile in operation that is more maneuverable than if the carry handle 25 was not stowed, as the robot 10 can pass under lower furniture and other objects without obstruction. With the carry handle 25 stowed, the carry handle 25 cannot snag or impact objects. With the carry handle 25 in the carry position, the entire robot 10 can be lifted by the carry handle 25, as shown in FIG. 6.

Figure 7:
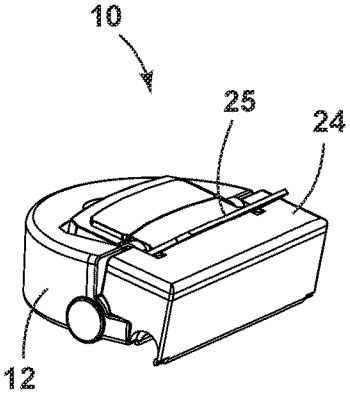
FIG. 7 is a rear isometric view of the robot of FIG. 3 showing the carry handle in an unlatched position.
Figure 8:
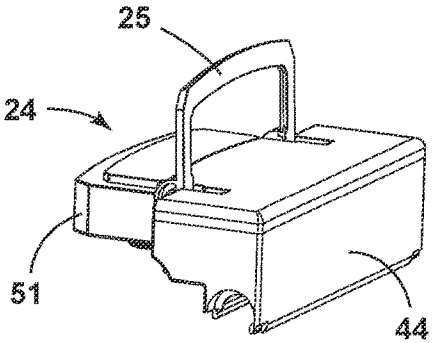
FIG. 8 is a rear isometric view of the tank of FIG. 3 showing the entire tank lifted by the carry handle.

Optionally, the carry handle 25 is movable to an unlatched position, one example of which is shown in FIG. 7, in which the tank assembly 24 can be separated from the housing 12. After the tank assembly 24 is separated, the tank assembly 24 can be lifted by the carry handle 25, as shown in FIG. 8. The position of the carry handle 25 when lifting the tank assembly 24 can be substantially the same as the position of the carry handle 25 when lifting the entire robot 10, i.e. the carry handle 25 can be in the carry position when lifting the entire robot 10 (FIG. 5) and when lifting just the tank assembly 24 (FIG. 8). The brushroll 41 is not shown in FIGS. 4-10 for the sake of clarity; however, the brushroll 41 remains with the housing 12 when the tank assembly 24 is removed from the housing 12.

Figure 9:
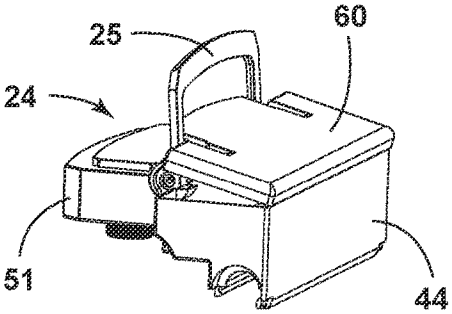
FIG. 9 is a rear isometric view of the tank of FIG. 3 showing the tank being opened.
Figure 10:
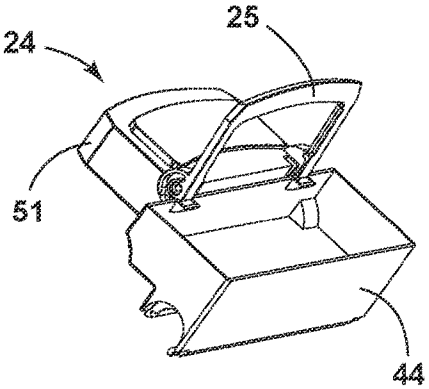
FIG. 10 is a rear isometric view of the tank of FIG. 3 showing the tank being emptied.

While separated from the housing 12, the recovery tank 44 can be emptied and/or the supply tank 51 can be refilled. For example, the recovery tank 44 can be emptied by opening the recovery tank 44, one example of which is shown in FIG. 9, and tipping or inverting the recovery tank 44 to pour out the collected contents as shown in FIG. 10. Conveniently, the user can hold the tank assembly 24 by the carry handle 25 in one hand and use their other hand to pivot one end of the tank assembly 24 upward to pour out the collected liquid and/or debris in the recovery tank 44, thereby avoiding contact with any of the wet or dirt surfaces of the tank assembly 24. It is noted that while FIGS. 4-10 are described with respect to the integrated tank assembly 24, these steps can be applicable to either the recovery tank 44 or the supply tank 51 individually in embodiments where the carry handle 25 is joined with, or otherwise provided on, the recovery tank 44 or the supply tank 51.

In the illustrated embodiment, the carry handle 25 is pivotally coupled to the tank assembly 24, and can be provided at an upper end of the robot 10 to be accessible from above for convenient lifting of the robot 10, although other locations are possible. In other embodiments, the carry handle 25 can slide or translate between the stowed and carry positions.

Having the tank assembly 24 removable from the top side of the housing 12 also provides a benefit for charging or docking the robot 10 because the tank assembly 24 can be removed when the robot 10 is seated in the charging cradle or docking station. The tank assembly 24 can be removed without disturbing any electrical contact needed for charging the battery 75 (FIG. 2).

The embodiment shown in the figures shows the entire tank assembly 24 as being removable from the housing 12 and carriable by the carry handle 25. It is understood that in other embodiments, a portion of the tank assembly 24 may be removable and carriable by the carry handle 25, while another portion is configured to remain with the housing 12. For example, the portion of the tank assembly 24 that holds liquid and/or debris, i.e. the recovery tank 44 and/or supply tank 51, may be removable and carriable by the carry handle 25, while another portion of the tank assembly 24 that does not hold liquid and/or debris is configured to remain with the housing 12.

Figure 11:
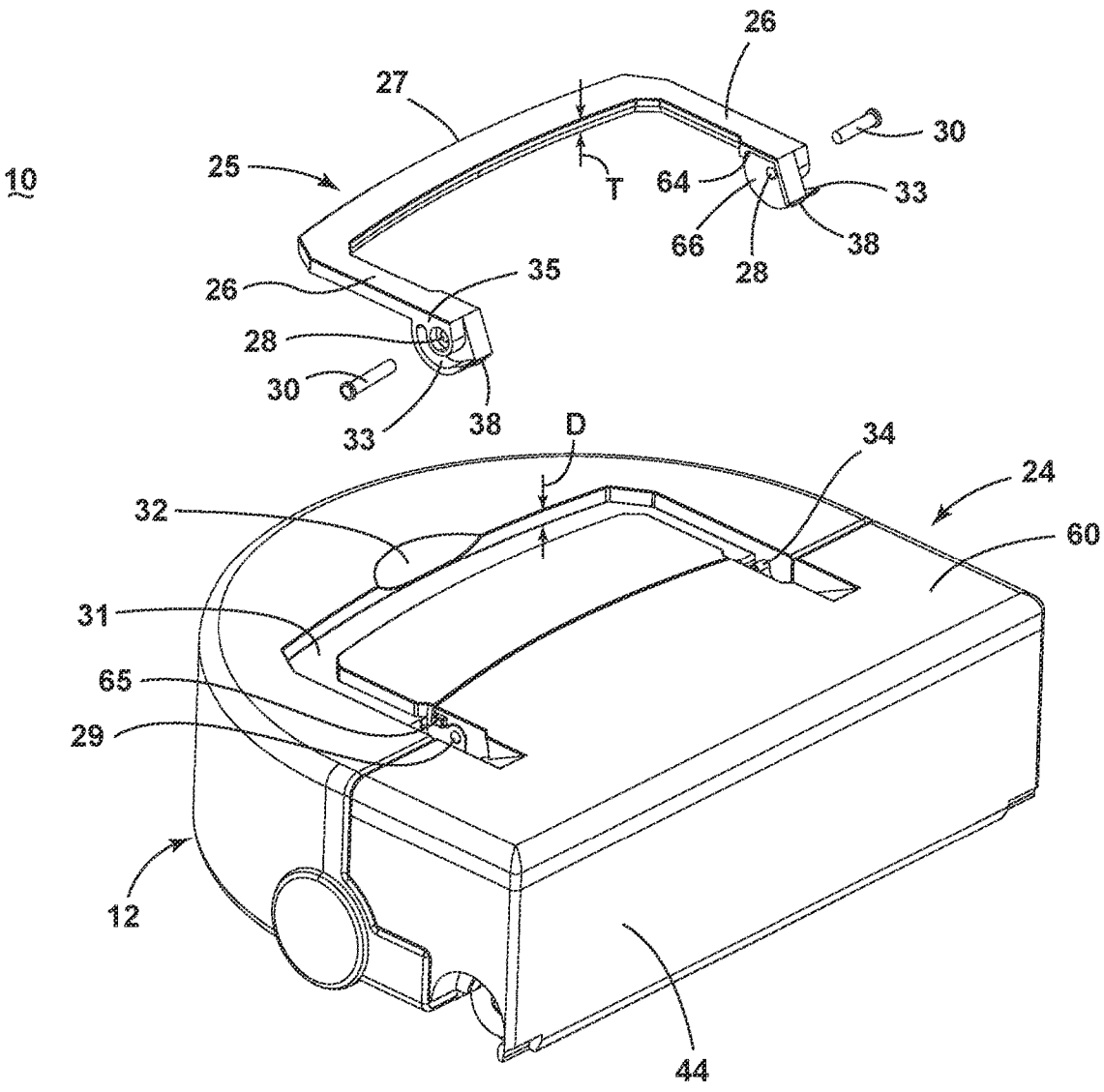
FIG. 11 is a partially exploded rear isometric view of the robot of FIG. 3.

Referring to FIG. 11, the carry handle 25 generally includes first and second handle ends 26 and a grip portion 27 extending between the handle ends 26. When in the carry position (ex: FIGS. 5 and 8), the grip portion 27 is offset from the housing 12 by the handle ends 26. The carry handle 25 can be configured as a generally U-shaped handle by integrally forming the handle ends 26 and grip portion 27 as a single molded piece. The grip portion 27 can optionally be overmolded or otherwise provided with a soft material for providing a comfortable hand grip to the user.

Still referring to FIG. 11, the carry handle 25 includes a pivot coupling with the tank assembly 24. The pivot coupling of the embodiment shown herein includes a pair of handle pivot apertures 28 formed on or otherwise suitably fixed to the handle ends 26, and a pair of coaxially aligned tank pivot apertures 29 formed on or otherwise suitably fixed to tank assembly 24. A pivot pin 30 is inserted through the coaxially aligned pivot apertures 28, 29 rotatably joins the carry handle 25 with the tank assembly 24 and defines a pivot axis P (see, for example, FIGS. 3 and 12) of the carry handle 25. Other pivot couplings are possible.

The robot 10 can include a handle recess 31 in which the carry handle 25 can be received in the stowed position. In the carry position, the carry handle 25 is pivoted or otherwise moved, out of the handle recess 31 to a position wherein a user may conveniently and easily grasp the extended grip portion 27. The handle recess 31 can have a depth D substantially equal to or greater than a thickness T of the carry handle 25 so that, when stowed, the carry handle 25 does not extend beyond the recess 31. In the embodiment shown herein, the handle recess 31 is formed by portions of the housing 12 and tank assembly 24, and the carry handle 25 is substantially flush with the surrounding portions of the tank assembly 24 and housing 12 when stowed. An indentation 32 can be formed in or otherwise provided on the housing 12 so a user can more easily lift the carry handle 25 out of the handle recess 31. The indentation 32 can adjoin the handle recess 31 so that a user can reach under a portion of the carry handle to grasp the grip portion 27.

Figure 12:
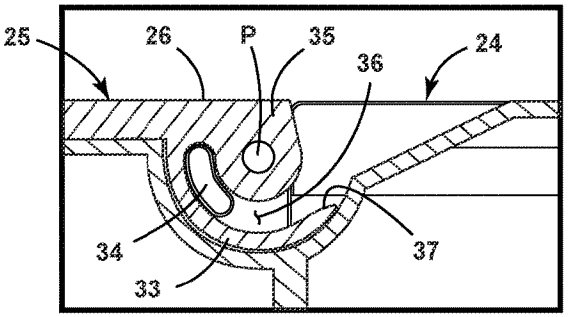
FIG. 12 is a sectional view through a latching assembly for the tank, showing the carry handle in a stowed position and the tank latched to the robot.
Figure 13:
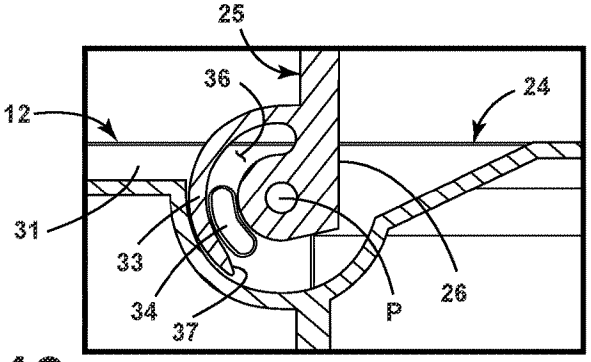
FIG. 13 is a view similar to FIG. 12, showing the carry handle in a carry position and the tank latched to the robot.
Figure 14:
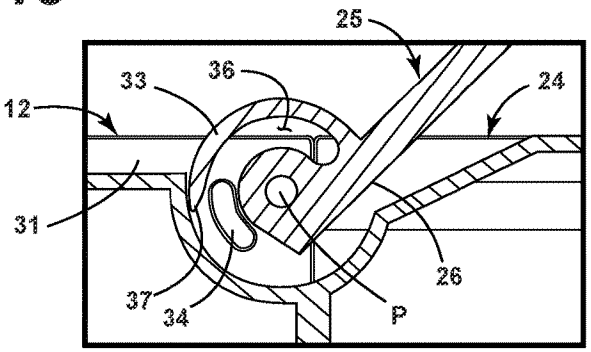
FIG. 14 is a view similar to FIG. 12, showing the carry handle in an unlatched position and the tank unlatched from the robot.

Referring additionally to FIGS. 12-14, the robot 10 can include a latching assembly that secures the tank assembly 24 on the housing 12. The latching assembly can include a tank latching member 33 on the carry handle 25 that engages a portion of the housing 12 to secure the tank assembly 24 on the housing 12 when the carry handle 25 is in the stowed position, as shown in FIG. 12. The housing 12 can include a tank retaining member 34 in selective register with the latching member 33, and which is engaged by the latching member 33 when the tank assembly 24 is seated on the housing 12 and the carry handle 25 is in the stowed position.

The latching assembly can be configured to retain the tank assembly 24 on the housing 12 when the carry handle 25 is in the carry position, as shown in FIG. 13, to prevent the tank assembly 24 from separating from the housing 12 when the entire robot 10 is being carried. The tank latching member 33 on the carry handle 25 remains in engagement with the tank retaining member 34 of the housing 12 to secure the tank assembly 24 on the housing 12 when the carry handle 25 is moved from the stowed position to the carry position.

In the embodiment shown herein, the carry handle 25 can include latching members 33 located on the handle ends 26, such as on opposing outer sides 35 of the handle ends 26, and the housing 12 can include corresponding tank retaining members 34 located in the handle recess 31. The latching members 33 can be sized and configured to engage the tank retaining members 34 and secure the tank assembly 24 on the housing 12 when the carry handle 25 is in the stowed position (FIG. 12), and when the carry handle 25 is in the carry position (FIG. 13). In one configuration, the latching members 33 include arcuate recesses 36 located concentrically about the pivot axis P. The arcuate recesses 36 can extend more than 90 degrees about the pivot axis P such that the tank retaining members 34 are received in the arcuate recesses 36 when the carry handle 25 is stowed (FIG. 12) and when the carry handle 25 is pivoted to the carry position (FIG. 13), which can include pivoting the carry handle 25 approximately 90 degrees to a position normal or orthogonal to the stowed position. The tank retaining members 34 can be arcuate members or other projections suitably configured to slide within the arcuate recesses 36 as the carry handle 25 pivots with respect to the housing 12.

The latching assembly can be configured to release the tank assembly 24 from engagement with the housing 12 when the carry handle 25 is in the unlatched position, as shown in FIG. 14, to permit the tank assembly 24 to be lifted away from the housing 12. In the unlatched position, the carry handle 25 is pivoted past the carry position, and the tank retaining member 34 on the housing 12 is clear of the tank latching member 33 on the carry handle 25. The arcuate recess 36 can have an open end 37 through which the tank retaining member 34 passes as the tank assembly 24 is lifted away from the housing 12. In the embodiment show herein, the carry handle 25 can be pivot past vertical, such as to a position approximately 120 degrees from the stowed position. The arcuate recesses 36 can extend approximately 120 degrees such that pivoting the carry handle 25 approximately 120 degrees from the stowed position to the unlatched position clears the tank retaining members 34 from the arcuate recess 36.

Figure 15:
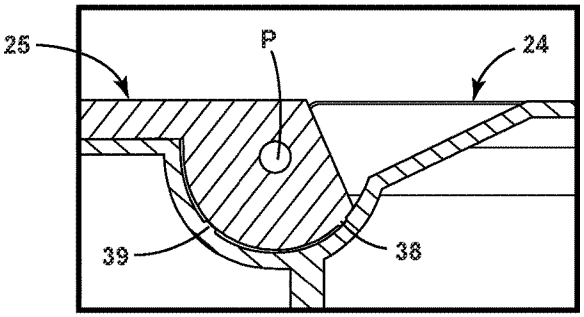
FIG. 15 is a sectional view through a detent mechanism for the carry handle, showing the carry handle in the stowed position.
Figure 16:
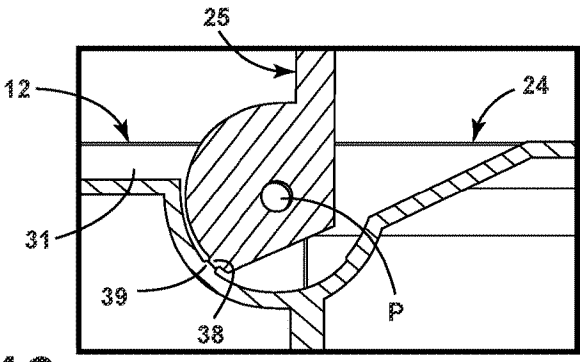
FIG. 16 is a view similar to FIG. 15, showing the carry handle in the carry position and retained by the detent mechanism.
Figure 17:
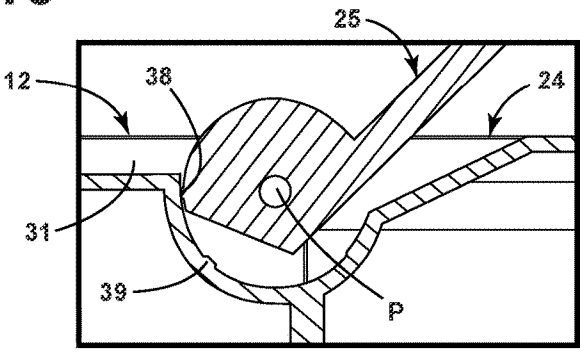
FIG. 17 is a view similar to FIG. 15, showing the carry handle in the unlatched position.

Referring additionally to FIGS. 15-17, the robot 10 can include a detent mechanism that helps maintain the carry handle 25 in the carry position. The detent mechanism resists or arrests the rotation of the carry handle 25 back to the stowed position or onward to the unlatched position. The detent mechanism can include a protrusion 38 on carry handle 25 that frictionally engages a detent on the tank assembly 24 to releasably retain the carry handle 25 in the carry position, shown in FIG. 16. In the embodiment shown herein, the carry handle 25 can include protrusions 38 on an outer surface of each of the handle ends 26, and the tank assembly 24 can include corresponding detents 39 located in the handle recess 31. The protrusions 38 can be sized and configured to fit into the detents 39 so that the carry handle 25 maintains the upright carry position even if a user lets go of the carry handle 25. In this position, the protrusions 38 and detents 39 cooperate by their engagement to help prevent the carry handle 25 from falling out of the vertical carry position. To move the carry handle to unlatched position (FIG. 17), the user applies force to the carry handle 25 to overcome the retaining force between the protrusions 38 and detents 39, and the protrusions 38 are forced past the detents 39 on the tank assembly 24. Optionally, the protrusion 38 is configured to snap into the detent 39, which can provide an audible click and/or tactile feedback to the user so that the user will know when the carry handle 25 reaches the carry position.

Other detent mechanisms are possible. For example, the locations of the protrusions 38 and detents 39 can be reversed, with the protrusions 38 provided on the tank assembly 24 and the detents 39 provided on the carry handle 25. In yet another configuration, the protrusions 38 or detents 39 can be provided on the housing 12 instead of the tank assembly 24. With this arrangement, the detent mechanism can maintain the carry handle 25 in the carry position when the tank assembly 24 is mounted on the housing 12, but not when the tank assembly 24 is removed from the housing.

Figure 18:
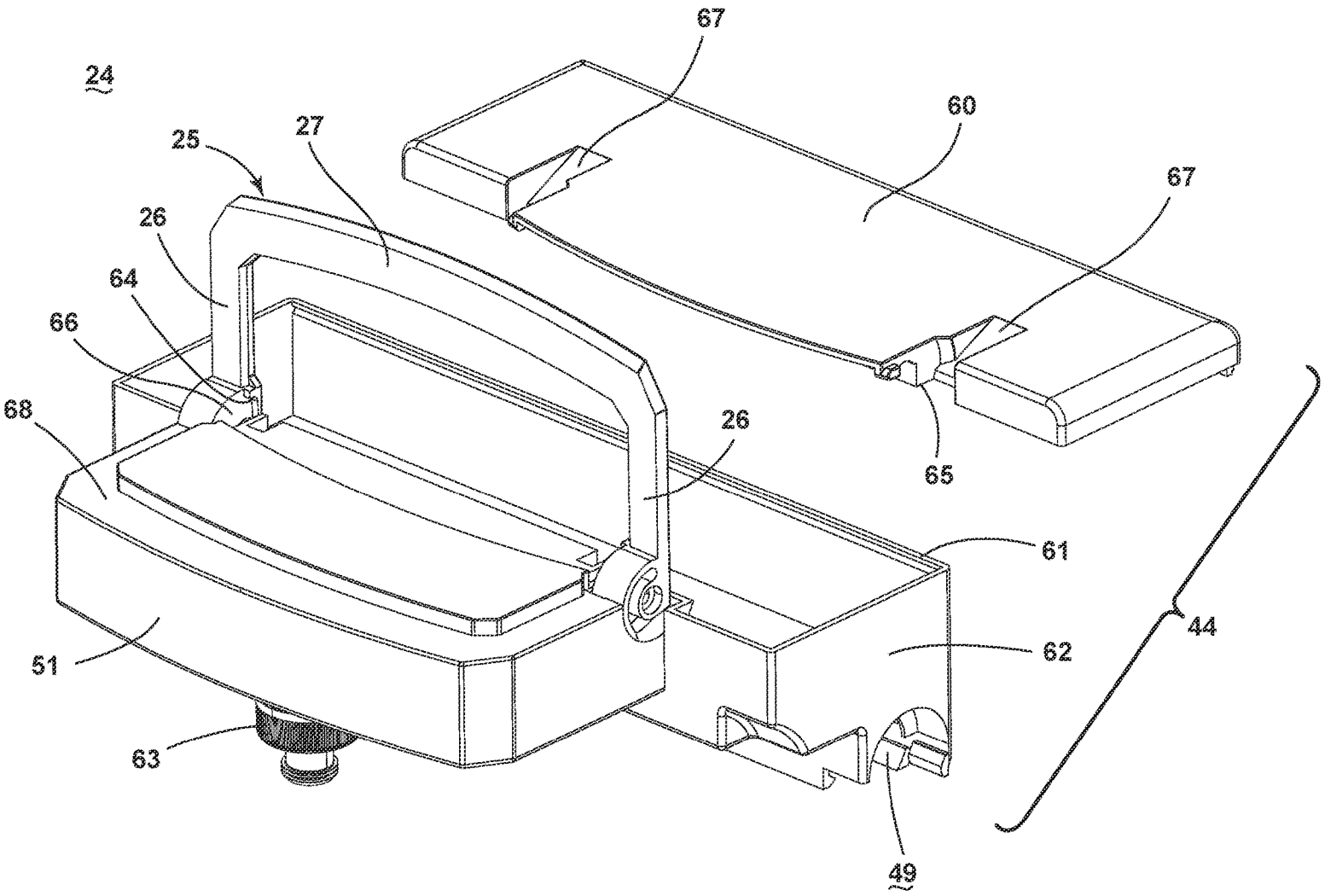
FIG. 18 is a partially exploded front isometric view of the tank of FIG. 3.

Referring to FIG. 18, the recovery tank 44 can have an openable lid or cover 60 to facilitate emptying the collected contents of the tank 44 and for sealingly closing an open top 61 or other opening of the recovery tank 44. In the embodiment shown herein, the cover 60 is removable from a tank body 62 defining a lower portion of the recovery tank 44, and optionally also defining the supply tank 51. The supply tank 51 can have a separate fill cap 63 to facilitate filling the supply tank 51. The fill cap 63 can include an integral valve assembly which opens upon seating the tank assembly 24 on the housing 12 to fluidly connect the supply tank 51 with the pump 53 (FIG. 1) and which automatically closes upon removing the tank assembly 24 from the housing 12.

In other embodiments, the cover 60 can be configured to close an opening of the supply tank 51 as well as the recovery tank 44, such that removable of the cover 60 allows the supply tank 51 to be filled. In yet another embodiment, the cover 60 can be applicable to either the recovery tank 44 or the supply tank 51 individually in embodiments where the recovery tank 44 and the supply tank 51 are provided as separate units rather than integrated as the tank assembly 24.

Figure 19:
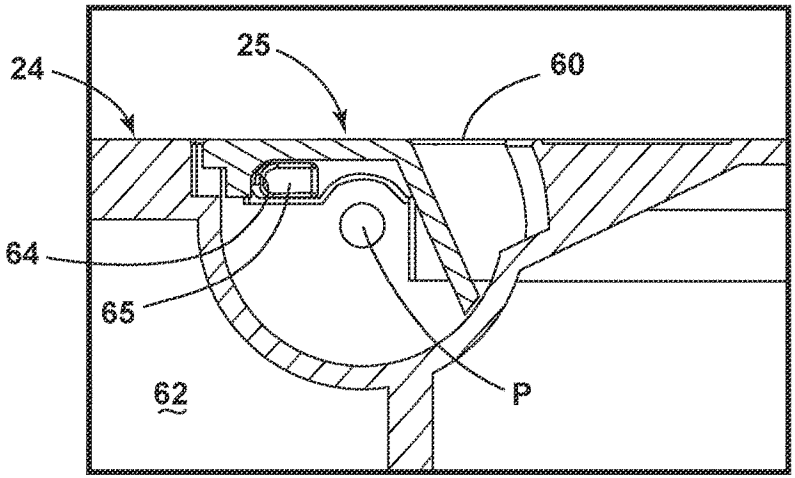
FIG. 19 is a sectional view through a cover retaining assembly for a cover of the tank, showing the carry handle in the stowed position and the cover latched to the tank.
Figure 20:
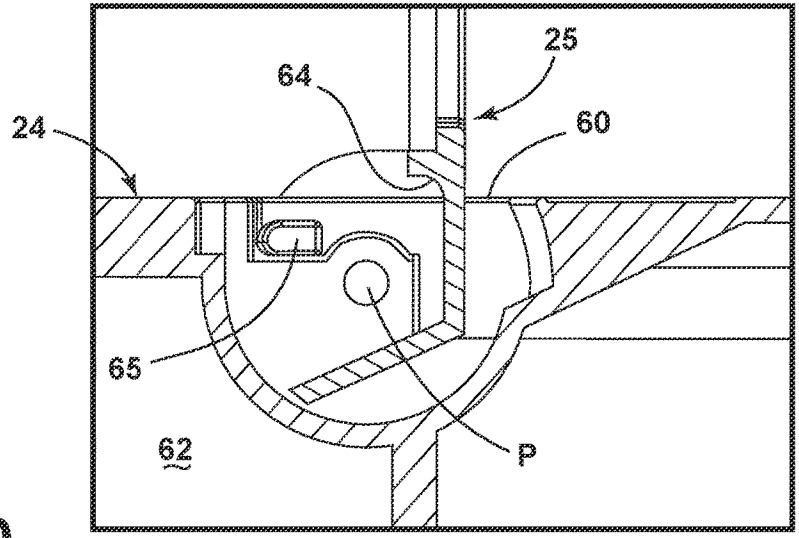
FIG. 20 is a view similar to FIG. 19, showing the carry handle in the carry position and the cover unlatched from the tank.

Referring additionally to FIGS. 19-20, the robot 10 can include a cover retaining assembly that retains the cover 60 on the tank body 62. The cover retaining assembly can include a cover latching member 64 on the carry handle 25 that engages a portion of the cover 60 to secure the cover 60 on the tank body 62 when the carry handle 25 is in the stowed position, as shown in FIG. 19, regardless of whether the tank assembly 24 is seated on the housing 12 or removed from the housing 12. The cover 60 can include a cover retaining member 65 in selective register with the latching member 64, and which is engaged by the latching member 64 when the carry handle 25 is in the stowed position.

The engagement of the cover latching member 64 with the cover retaining member 65 can include the latching member 64 covering or overlaying the retaining member 65 to prevent the cover 60 from being lifted off the tank body 62. When the cover 60 is seated on the tank body 62, the retaining member 65 is disposed on a first side of the pivot axis P. In the stowed position of the carry handle 25, the latching member 64 is disposed on the same first side of the pivot axis P over the retaining member 65, as shown in FIG. 19. Pivoting the carry handle 25 to the carry position, as shown in FIG. 20, moves the latching member 64 to a second side of the pivot axis P, such that no portion of the latching member 64 overlies the retaining member 65, and the cover 60 is otherwise unobstructed by the carry handle 25.

In the embodiment shown herein, the carry handle 25 can include latching members 64 located on the handle ends 26, such as on opposing inner sides 66 of the handle ends 26, and the cover 60 can include corresponding cover retaining members 65 located on opposing outer edges of the cover 60. Optionally, the cover 60 can form portions 67 of the handle recess 31 (FIG. 11), and the cover retaining members 65 can be located within the handle recess 31. As shown in FIG. 18, another portion 68 of the handle recess 31 can be formed with the tank body 62, including being molded in the supply tank 51.

The cover latching members 64 can be sized and configured to overlay the cover retaining members 65 and secure the cover 60 on the tank body 62 when the carry handle 25 is in the stowed position (FIG. 19). When the carry handle 25 is pivoted out of the stowed position, such as to the carry position (FIGS. 6, 8, 9, and 20) or the unlatched position (FIG. 7), the cover latching members 64 do not overlay the cover retaining members 65 and the cover 60 can be removed from the tank body 62. Having the cover 60 removable when the carry handle 25 is in the carry position can be of particular convenience to the user, as this enables the user to remove the cover 60 when carrying the tank assembly 24 (e.g., FIG. 8-10).

Referring to FIG. 2, in one embodiment, the robot 10 can include a handle sensor 112 which can be configured to detect when the carry handle 25 is moved out of the stowed position, e.g. if a user lifts the carry handle 25 out of the handle recess 31. This information is provided as an input to the controller 20, which can deactivate the robot 10 in response to the carry handle 25 moving out of the stowed position. Deactivating the robot 10 can include halting operation of any one or more of the pump motor 54, brush motor 42, vacuum motor 47, or wheel motors 72. The handle sensor 112 may also detect when the carry handle 25 is in the stowed position, such as when the user places the carry handle 25 back in the handle recess 31. Upon such input, the controller 20 may reactive the robot 10, such as by resuming operation of any one or more of the pump motor 54, brush motor 42, vacuum motor 47, or wheel motors 72.

The handle sensor 112 can comprise any sensor configured to detect when the carry handle 25 is not in the stowed position. For example, the handle sensor 112 can be a pressure sensor located in the handle recess 31 for detecting the weight of the carry handle 25. In another example, the handle sensor 112 can be a magnetic sensor for detecting the presence of the carry handle 25 in the handle recess 31.

It is noted that the handle sensor 112 can work in conjunction with the lift-up sensors 106. For example, if the robot 10 is lifted up by the carry handle 25, input from the handle sensor 112 can be used to reactive the robot 10. However, if the robot 10 is lifted with the carry handle 25 still stowed, input from the lift-up sensors 106 can be used to reactive the robot 10.

Figure 21:
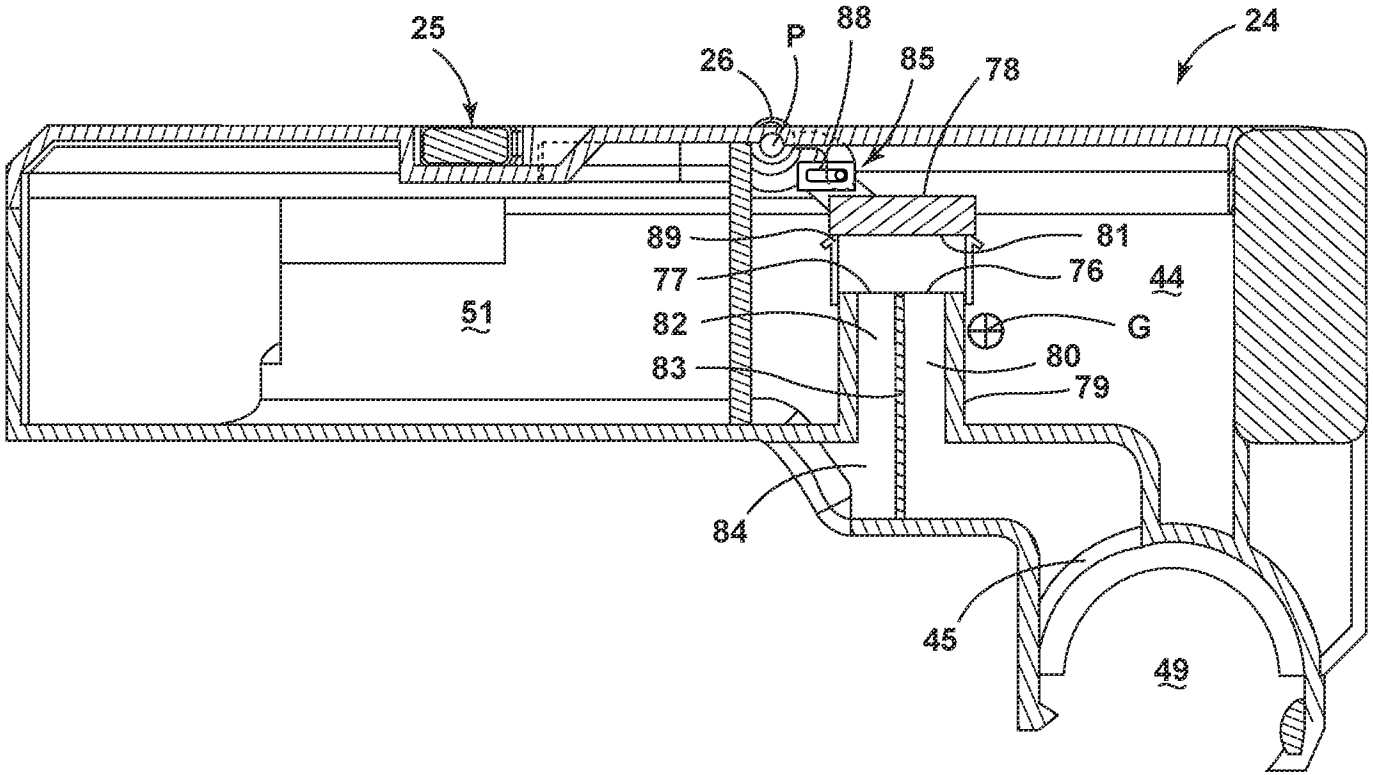
FIG. 21 is sectional illustration of another embodiment of a tank for the floor cleaning robot of FIG. 3 showing a blocking mechanism for sealing an opening of the tank when the tank is carried by the carry handle.

FIG. 21 is a sectional illustration of another embodiment of a tank assembly 24 that can be utilized in the robot 10. The tank assembly 24 illustrated in FIG. 21 can include the various elements and functions as described in FIGS. 3-20, and like parts will be identified with like numerals. The recovery tank 44 includes an inlet 76 and an outlet 77. The carry handle 25 can include a mechanism to block the inlet 76 and/or the outlet 77 of the recovery tank 44 when the carry handle 25 is in the carry position. In the embodiment, described herein, the blocking mechanism blocks both the inlet 76 and the outlet 77 of the recovery tank 44 when the carry handle 25 is in the carry position. In other embodiments, the blocking mechanism can block only the inlet 76 or only the outlet 77. In yet other embodiments, separate blocking mechanism can be provided for the inlet 76 and the outlet 77.

In the embodiment shown herein, the blocking mechanism comprises a cap 78 that is mechanically linked with the carry handle 25 such that movement of the carry handle 25 to the carry position moves the cap 78 into sealing engagement with the inlet 76 and the outlet 77 to block the inlet 76 and the outlet 77 of the recovery tank 44. The cap 78 essentially blocks the recovery pathway, and prevents liquid or debris collected in the recovery tank 44 from spilling out of the tank 44. Movement of the carry handle 25 to the stowed position moves the cap 78 out of sealing engagement with the inlet 76 and the outlet 77 and unblocks the recovery pathway so that liquid and debris can move through the inlet 76 and/or the outlet 77 when the recovery system 40 is activated to generate a partial vacuum at the surface to be cleaned for removing liquid and debris from the surface to be cleaned.

The suction nozzle 45 is fluidly coupled with the inlet 76 to the recovery tank 44. The inlet 76 is optionally formed on a standpipe 79 in the recovery tank 44, and recovered liquid and/or debris moves up through an inlet conduit 80 of the standpipe 79 and exits the standpipe 79 through the inlet 76. Optionally, a deflector 81 can be provided in the path of the liquid and debris exiting the standpipe 79 through the inlet 76. Liquids and debris impact the deflector 81 and fall from the working air to settle under force of gravity to the bottom of the recovery tank 44.

The relatively clean working air is drawn through the outlet 77 of the recovery tank 44, which is in fluid communication with the suction source 46 (FIG. 1). Optionally, the outlet 77 is also formed on the standpipe 79, and leads into an outlet conduit 82 formed adjacent to the inlet conduit 80 and separated therefrom by at least one wall 83. The working air entering the standpipe 79 through the outlet 77 moves down the outlet conduit 82 and into a clean air conduit 84 that is fluidly connected to an inlet of the vacuum motor 47 (FIG. 1).

The deflector 81 can be joined with or otherwise formed on the cap 78 using any suitable joining or forming method. In the embodiment shown herein, the deflector 81 is defined by a bottom surface of the cap 78. Liquids and debris exiting the standpipe 79 through the inlet 76 impact the bottom surface of the cap 78 and fall from the working air to settle under force of gravity to the bottom of the recovery tank 44.

Figure 22:
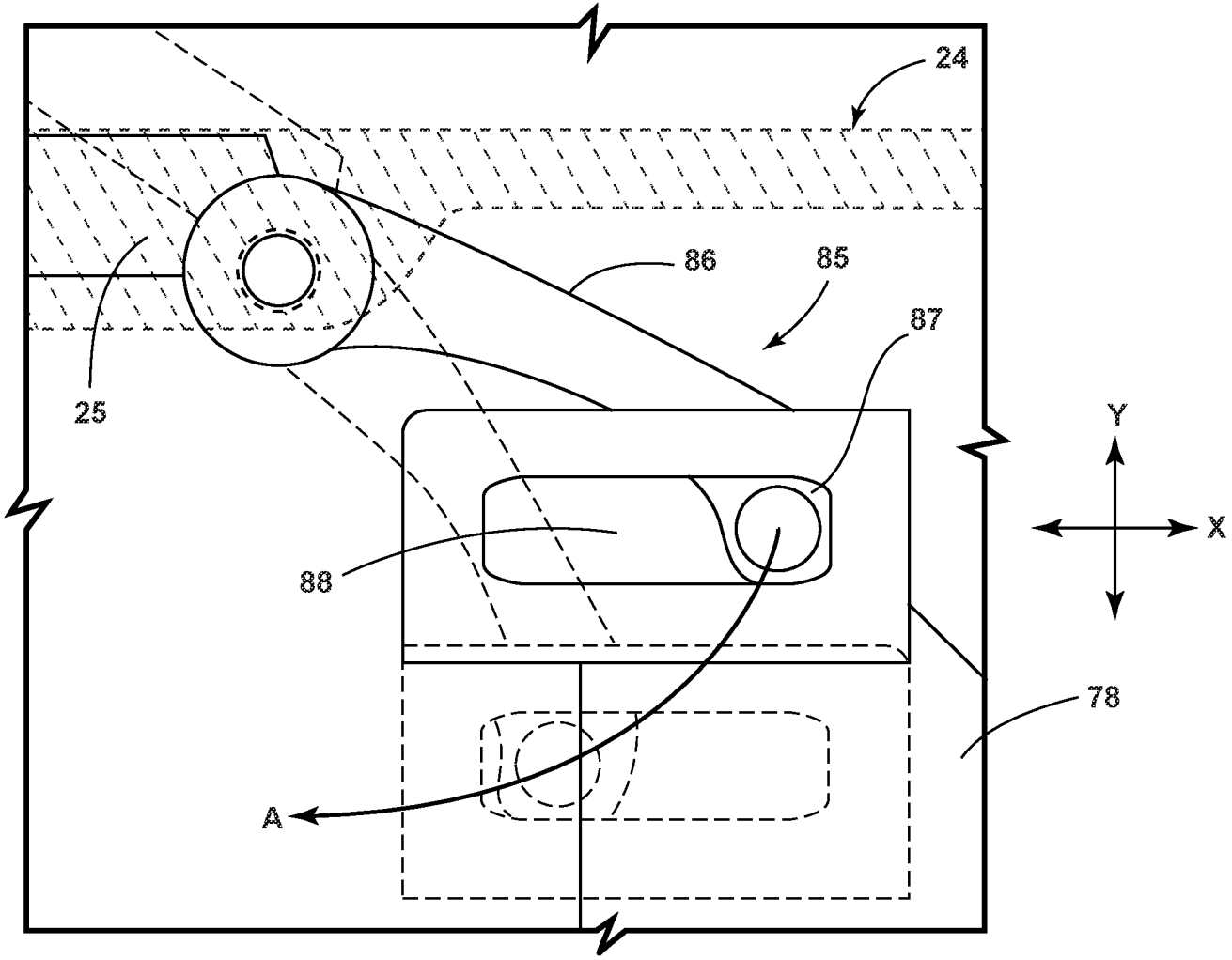
FIG. 22 is a schematic illustration of a mechanical linkage for the blocking mechanism of FIG. 21.

One embodiment of a mechanical linkage 85 between the carry handle 25 and the blocking mechanism or cap 78 is shown in FIG. 22. The mechanical linkage 85 raises the cap 78 away from the inlet 76 and outlet 77 when the carry handle 25 is stowed, and lowers the cap 78 to seal the inlet 76 and outlet 77 when the carry handle 25 is pivoted up to the carry position. It is understood that other mechanical linkages are possible. Further, while a mechanical linkage between the carry handle 25 and the cap 78 is illustrated herein, in other embodiments, the cap 78 can be electrically actuated or otherwise actuated via the pivoting of the carry handle 25.

The mechanical linkage 85 includes a lever arm 86 having two ends, including a first end rigidly connected to the carry handle 25 and a second end having a pin 87 joined therewith or otherwise formed thereon. At least the second end of the lever arm 86 extends into the tank assembly 24 and moves in an arc, indicated by arrow A, as the carry handle 25 is lifted to the carry position, one example of which is shown phantom line in FIG. 22. In the embodiment shown herein, movement of the second end of the lever arm 86 through the arc translates the pin 87 down in a vertical or Y-direction and forward in a horizontal or X-direction. The pin 87 sits within a slot 88 rigidly connected to, or otherwise formed on, the cap 78. The cap 78 can be constrained for movement only in the vertical or Y-direction. As the carry handle 25 rotates to the carry position, the pin 87 simultaneously slides within the slot 88 and exerts a force downwardly on the cap 78. The cap 78 is forced downwardly in the vertical or Y-direction to seal the inlet 76 and outlet 77 (FIG. 21) of the recovery tank 44.

The carry handle 25 of the embodiment shown in FIGS. 21-22 can be constrained to pivot through an acute angle from the stowed position, shown in solid line in FIG. 22, to the carry position, shown in phantom line in FIG. 22. In other embodiments, the mechanical linkage 85 can be configured for a carry handle 25 that rotates approximately 90 degrees between the stowed and carry positions, as shown in the embodiment of FIGS. 3-20, and can further optionally be configured for a carry handle 25 that rotates further to the unlatched position, as shown in FIGS. 7, 14 and 17.

One or more gaskets 89 can be carried on the cap 78 for creating a fluid-tight seal at the inlet 76 and outlet 77 when the cap 78 is lowered or closed against the inlet 76 and outlet 77. The gasket 89 can be located on the bottom of the cap 78 to seal against the top of the standpipe 79 when the cap 78 is in the lowered position. One gasket 89 can be provided to seal the inlet 76 and the outlet 77. Alternatively, separate gaskets 89 can be provided to seal the inlet 76 and the outlet 77.

In certain embodiments, the weight of the robot 10 can be distributed such that it tends to apply force through the blocking mechanism to compress the gasket 89 that seals against the inlet 76 and the outlet 77. For example, as the user lifts up the tank assembly 24, or the entire robot 10 if the tank assembly 24 is mounted to the housing 12, the weight of the tank assembly 24 or entire robot 10 applies a force to the gasket 89 via the mechanical linkage 85. The center of gravity G of the tank assembly 24 can be located lower than the pivot axis P of the carry handle 25, so that the weight of the tank assembly 24 adds a moment force in the direction which helps to keep pressure on the gasket 89. Similarly, the center of gravity (not shown) of the robot 10 can be located lower than of the pivot axis P to keep pressure on the gasket 89. Additionally, the center of gravity G of the tank assembly 24, and optionally the center of gravity (not shown) of the robot 10, can be located forwardly of the pivot axis P of the carry handle 25, to further increase the moment force. An exemplary location for the center of gravity G of the tank assembly 24 is shown in FIG. 21; in other embodiments, the center of gravity G can be located at other points. Alternatively, the center of gravity G of the tank assembly 24, and optionally the center of gravity (not shown) of the robot 10, can be located directly underneath, i.e. orientated along a common vertical plane, of the pivot axis P of the carry handle 25.

Figure 23:
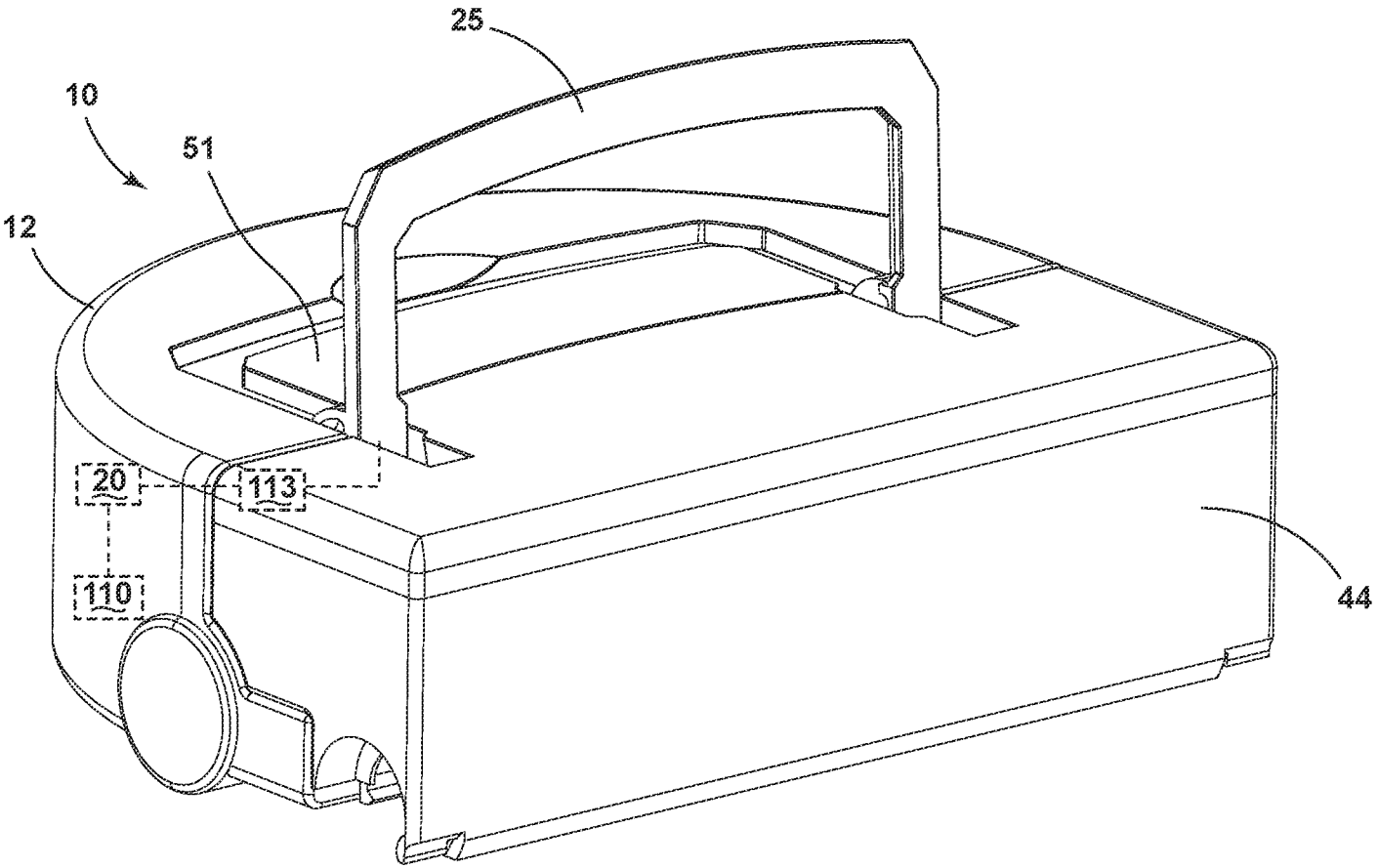
FIG. 23 is a schematic illustration of another embodiment of a floor cleaning robot having a tank and a carry handle in accordance with various aspects described herein.

FIG. 23 is a schematic illustration of another embodiment of the robot 10. The robot 10 illustrated in FIG. 23 can include the various elements and functions as described in FIGS. 3-22, and like parts will be identified with like numerals. In this embodiment, information from the one or more tank sensors 110 (FIG. 2) can be used to automatically move the carry handle 25 out of the stowed position. The tank sensors 110 can detect a condition of the tank, such as when the recovery tank 44 full, or reaches a predetermined fullness or weight, and/or can detect when the supply tank 51 is empty, or reaches a predetermined emptiness or weight. Such information is provided as an input to the controller 20, which may prevent operation of the robot 10 until the supply tank 51 is filled and/or the recovery tank 44 is emptied, and may further move the carry handle 25 out of the stowed position, such as to the carry position, to alert the user to that action is required. The carry handle 25 provides a visual queue that the robot 10 requires the user's attention, and that the robot 10 will not operate until rectified. Alternatively, the user alert can comprise a visual or audible notification issued by the robot 10 indicating the condition of the tank, such as that the recovery tank 44 full or that the supply tank 51 is empty.

The robot 10 can include an actuator 113 for automatically moving the carry handle 25 out of the stowed position, and optionally back to the stowed position. The actuator 113 can be any suitable actuator for the purposes described herein, i.e. moving the carry handle 25 to and from the stowed position, including, but not limited to, a mechanical, electrical, or pneumatic actuator. The actuator 113 can receive inputs from the controller 20 for moving the carry handle 25 out of the stowed position, based on inputs from the tank sensors 110. The actuator 113 can likewise receive inputs from the controller 20 for moving the carry handle 25 back to the stowed position once the robot is ready for operation.

There are several advantages of the present disclosure arising from the various aspects or features of the apparatus, systems, and methods described herein. For example, aspects described above provide an autonomous cleaning robot with a carry handle that can be grasped by a user to lift the entire robot from a floor surface and carry the robot to a different location. The carry handle can also be used grasped by a user to lift a tank away from the housing of the robot, and carry the tank to a location for refilling and/or emptying. With a wet cleaning robot, liquid in the supply and/or recovery tanks can slosh around and spill out when lifting and carrying the robot, or when lifting and carrying just the individual tank(s). The carry handle helps the user hold the robot or tank(s) steady and level, and reduces or eliminates liquid spillage.

Another advantage of aspects of the disclosure relates to the stowability of the carry handle. Embodiments disclosed herein provide a carry handle that is easily accessed when required, and stowed on the unit during operation to maintain a low profile robot that is highly maneuverable.

Yet another advantage of aspects of the disclosure is that the carry handle includes one or more capturing assemblies such that the carry handle can be selectively rotated between different orientations so that a user can: lift and carry the entire floor cleaner; selectively separate the tank from the housing; lift and carry the tank; and empty or refill the tank as needed. The one or more capturing assemblies allow for: locking/securing the tank to the housing, activating/deactivating the floor cleaner based on handle position; carrying the entire floor cleaner; ejecting the tank from the housing; carrying the tank separately; and emptying the tank.

Still another advantage of aspects of the disclosure relates to the blocking mechanism operated by the carry handle. The blocking mechanism block the inlet and/or outlet of the tank when the carry handle is moved from the stowed position to the carry position. As the tank is being carried, the openings into and out of the tank are sealed, preventing liquid or debris from spilling out of the tank.

Yet another advantage of aspects of the disclosure relates to activating and deactivating the robot based on the position of the carry handle. Using a sensor that detects the position of the carry handle, the controller can determine whether enable or disable certain components of the robot. For instance, with the carry handle pivoted up to the carry position, the controller can automatically deactivate the robot in anticipation of the user lifting up the robot or tank by the carry handle. A user does not have to remember to turn off the robot before lifting it up or detaching the tank.

To the extent not already described, the different features and structures of the various embodiments of the invention, may be used in combination with each other as desired, or may be used separately. That one autonomous floor cleaner or floor cleaning robot is illustrated herein as having all of these features does not mean that all of these features must be used in combination, but rather done so here for brevity of description. Thus, the various features of the embodiments, including but not limited to the tank latching assembly, the handle detent mechanism, the cover retaining assembly, the handle sensor, and the blocking mechanism, may be mixed and matched in various cleaning apparatus configurations as desired to form new embodiments, whether or not the new embodiments are expressly described.

While various embodiments illustrated herein show an autonomous floor cleaner or floor cleaning robot, aspects of the invention may be used on other types of surface cleaning apparatus and floor care devices, including, but not limited to, an upright extraction device (e.g., a deep cleaner or carpet cleaner) having a base and an upright body for directing the base across the surface to be cleaned, a canister extraction device having a cleaning implement connected to a wheeled base by a vacuum hose, a portable extraction device adapted to be hand carried by a user for cleaning relatively small areas, or a commercial extractor. Still further, aspects of the invention may also be used on surface cleaning apparatus other than extraction cleaners, such as a steam cleaner or a vacuum cleaner. A steam cleaner generates steam by heating water to boiling for delivery to the surface to be cleaned, either directly or via cleaning pad. Some steam cleaners collect liquid in the pad, or may extract liquid using suction force. A vacuum cleaner typically does not deliver or extract liquid, but rather is used for collecting relatively dry debris (which may include dirt, dust, stains, soil, hair, and other debris) from a surface.

The above description relates to general and specific embodiments of the disclosure. However, various alterations and changes can be made without departing from the spirit and broader aspects of the disclosure as defined in the appended claims, which are to be interpreted in accordance with the principles of patent law including the doctrine of equivalents. As such, this disclosure is presented for illustrative purposes and should not be interpreted as an exhaustive description of all embodiments of the disclosure or to limit the scope of the claims to the specific elements illustrated or described in connection with these embodiments. Any reference to elements in the singular, for example, using the articles "a," "an," "the," or "said," is not to be construed as limiting the element to the singular.

Likewise, it is also to be understood that the appended claims are not limited to express and particular components or methods described in the detailed description, which may vary between particular embodiments that fall within the scope of the appended claims. With respect to any Markush groups relied upon herein for describing particular features or aspects of various embodiments, different, special, and/or unexpected results may be obtained from each member of the respective Markush group independent from all other Markush members. Each member of a Markush group may be relied upon individually and or in combination and provides adequate support for specific embodiments within the scope of the appended claims.

What is claimed is:

1. An autonomous floor cleaner comprising:

an autonomously moveable housing;

a controller;

a drive system operably coupled with the controller and adapted to autonomously move the housing over a surface to be cleaned;

at least one tank removably mounted on the housing and adapted to hold liquid, the at least one tank comprising an inlet and an outlet; and a carry handle joined with the at least one tank, the carry handle movable between multiple positions, including a first position and a second position, wherein the autonomous floor cleaner can be lifted via the carry handle in the second position; and a blocking mechanism coupled with the carry handle, wherein the blocking mechanism blocks at least one of the inlet and the outlet in the second position and unblocks the at least one of the inlet and the outlet in the first position.

2. The autonomous floor cleaner of claim 1, wherein the blocking mechanism comprises a cap with a gasket that seals against the at least one of the inlet and the outlet in the second position.

3. The autonomous floor cleaner of claim 1, wherein the blocking mechanism blocks both the inlet and the outlet in the second position.

4. The autonomous floor cleaner of claim 1, wherein the blocking mechanism comprises a cap that is mechanically linked with the carry handle such that movement of the carry handle to the second position moves the cap into sealing engagement with the at least one of the inlet and the outlet, and movement of the carry handle to the first position moves the cap out of sealing engagement with the at least one of the inlet and the outlet.

5. The autonomous floor cleaner of claim 4, wherein the cap comprises a deflector in a path of liquid and debris passing through the inlet.

6. The autonomous floor cleaner of claim 4, comprising a mechanical linkage between the carry handle and the cap, the mechanical linkage comprising a lever arm having a first end rigidly connected to the carry handle and a second end having a pin within a slot of the cap.

7. The autonomous floor cleaner of claim 1, comprising a suction nozzle fluidly coupled with the inlet and a suction source fluidly coupled with the outlet.

8. The autonomous floor cleaner of claim 7, wherein the tank comprises a standpipe having an inlet conduit with the inlet at an upper end thereof, with a lower end of the inlet conduit in fluid communication with the suction nozzle.

9. The autonomous floor cleaner of claim 8, wherein the standpipe comprises an outlet conduit with the outlet at an upper end thereof, with a lower end of the outlet conduit in fluid communication with the suction source.

10. The autonomous floor cleaner of claim 1, wherein:

the carry handle is pivotally coupled to the at least one tank for movement about a pivot axis; and the at least one tank has a center of gravity located below the pivot axis.

11. The autonomous floor cleaner of claim 1, comprising a latching assembly configured to secure the at least one tank on the housing when the carry handle is in the first position and in the second position.

12. The autonomous floor cleaner of claim 11, wherein the latching assembly comprises a tank latching member on the carry handle that engages a portion of the housing to secure the at least one tank on the housing when the carry handle is in the first position, and wherein the carry handle is moveable to a third position in which the at least one tank can be separated from the housing.

13. The autonomous floor cleaner of claim 12, wherein:

the housing comprises a tank retaining member in selective register with the tank latching member on the carry handle, and which is engaged by the tank latching member when the at least one tank is mounted on the housing and the carry handle is in the first position; and the tank latching member on the carry handle is configured to remain in engagement with the tank retaining member to secure the at least one tank on the housing as the carry handle is moved from the first position to the second position.

14. The autonomous floor cleaner of claim 13, wherein:

the carry handle is pivotally coupled to the at least one tank for movement about a pivot axis; and the tank latching member comprises an arcuate recess located concentrically about the pivot axis, with the tank retaining member configured to slide within the arcuate recess as the carry handle pivots.

15. The autonomous floor cleaner of claim 14, wherein the arcuate recess extends more than 90 degrees about the pivot axis.

16. The autonomous floor cleaner of claim 1, comprising:

a detent on one of the carry handle and the at least one tank; and a protrusion on the other one of the carry handle and the at least one tank, the protrusion configured to frictionally engage the detent in the second position to releasably retain the carry handle in the second position.

17. The autonomous floor cleaner of claim 1, comprising:

a removable cover for the at least one tank;

a cover retaining member on the cover; and a cover latching member on the carry handle, and which engages the cover retaining member on the cover when the carry handle is in the first position to secure the cover on the tank.

18. The autonomous floor cleaner of claim 1, wherein:

the carry handle is pivotally coupled to a top side of the at least one tank for movement about a pivot axis;

the tank is removable from a top side of the housing; and in the first position, the carry handle is stowed such that an overall height of the autonomous floor cleaner is reduced in comparison to an overall height of the autonomous floor cleaner with the carry handle in the second position.

19. The autonomous floor cleaner of claim 1, wherein at least one of the housing and the at least one tank comprises a handle recess that stows the carry handle in the first position, the handle recess having have a depth substantially equal to or greater than a thickness of the carry handle such that the carry handle does not extend beyond the handle recess in the first position.

20. The autonomous floor cleaner of claim 1, wherein the at least one tank comprises a tank assembly, the tank assembly comprising a recovery tank and a supply tank that are removable together from the housing.

* * * * *